United States Patent [19]

Torme

[11] 4,408,425

[45] Oct. 11, 1983

[54] WINDOW MOISTURE AND AIR FLOW CONTROL DEVICE

[76] Inventor: Helen M. Torme, 3450 N. Lake Shore Dr., Chicago, Ill. 60657

[21] Appl. No.: 291,792

[22] Filed: Aug. 10, 1981

[51] Int. Cl.[3] ..... E06B 7/12

[52] U.S. Cl. ..... 52/171

[58] Field of Search ..... 52/171, 172, 37, 169.5, 52/169.14; 428/71, 76, 311.5, 311.7, 311.9, 316.6; 2/DIG. 11

[56] References Cited

U.S. PATENT DOCUMENTS

| | | | |
|---|---|---|---|
| 1,861,242 | 5/1932 | Randolph | 52/172 |
| 2,929,071 | 3/1960 | Sterling | 52/68 |
| 3,523,536 | 8/1970 | Ruffo | 428/311.5 |
| 4,064,666 | 12/1977 | Kinlaw | 52/171 |
| 4,065,884 | 1/1978 | Tenquist | 52/37 |

FOREIGN PATENT DOCUMENTS

| | | | |
|---|---|---|---|
| 1950589 | 10/1969 | Fed. Rep. of Germany | 52/171 |
| 6513355 | 8/1966 | Netherlands | 428/71 |
| 821194 | 9/1959 | United Kingdom | 49/495 |
| 2045845 | 11/1980 | United Kingdom | 52/172 |

*Primary Examiner*—John E. Murtagh
*Assistant Examiner*—Kathryn Ford
*Attorney, Agent, or Firm*—Wood, Dalton, Phillips, Mason & Rowe

[57] ABSTRACT

A window moisture and air flow control device adapted to be removably placed on a windowsill or the like for collecting condensate and permitting the collected condensate to evaporate to the ambient atmosphere. The device further acts to prevent air flow through openings covered by the device when so installed. The device includes a block of liquid-absorbent material and wicking material enclosing the block and extending over substantially the entire outer surface of the block.

8 Claims, 3 Drawing Figures

WINDOW MOISTURE AND AIR FLOW CONTROL DEVICE

BACKGROUND OF THE INVENTION

1. Field of the Invention

This invention relates to window structures and in particular to a device for controlling condensate and air flow relative to window structures.

2. Description of the Background Art

Carl A. Randolph, in U.S. Pat. No. 1,861,242, shows a frost and moisture absorber for windows wherein an absorbent element is provided in a recess of a mounting strip so as to have moisture transfer engagement solely with the window glass and requiring the absorbent material to be removed and squeezed into a larger receptacle for disposal. Because no means for automatically removing the moisture is provided, the device is disclosed as being adapted to handle the amount of moisture from frost on the window only for several hours.

Joe C. Kinlaw, in U.S. Pat. No. 4,064,666, discloses a condensate absorption and evaporation assembly wherein a thin sheet of absorbent material is provided in a trough-shaped metal frame. By absorbing the moisture, the material disperses it throughout the surface opposite the surface engaging the trough.

In U.S. Pat. No. 4,065,884, David A. Tenquist shows a window drip collector wherein an outer housing is provided with apertures and filled with foam or other absorbent material. The apertures are in the upper and lower walls of the housing. The foam is provided with vertical notches so that air flow may pass upwardly through the housing openings to assist in evaporating the collected moisture. One edge portion of the absorbent material is received in the recess of a wall which is adhesively secured to the window glass.

SUMMARY OF THE INVENTION

The present invention comprehends an improved window condensate and air flow control means providing substantial improvement in the operating efficiency thereof.

More specifically, the invention comprehends the provision of a window moisture and air flow control device including a block of liquid absorbing material, and wicking means enclosing the block defining outwardly exposed means for conducting liquid by wicking action to and from the block effectively over the entire outer surface of the block, tThe wicking means being flexible and further defining means for blocking air flow through a crack covered by the device.

In the illustrated embodiment, the wicking means comprises a rough textured fabric.

In the illustrated embodiment, the device includes means for removably securing the wicking means about the block.

The block may be formed of an open cell material and, in the illustrated embodiment, is formed of a synthetic resin.

The block, in the illustrated embodiment, defines a parallelepiped outer surface, with the wicking material being disposed in fluid transfer association with substantially the entire outer surface.

The control device of the present invention is extremely simple and economical of construction, while yet providing substantially improved moisture and air flow control.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
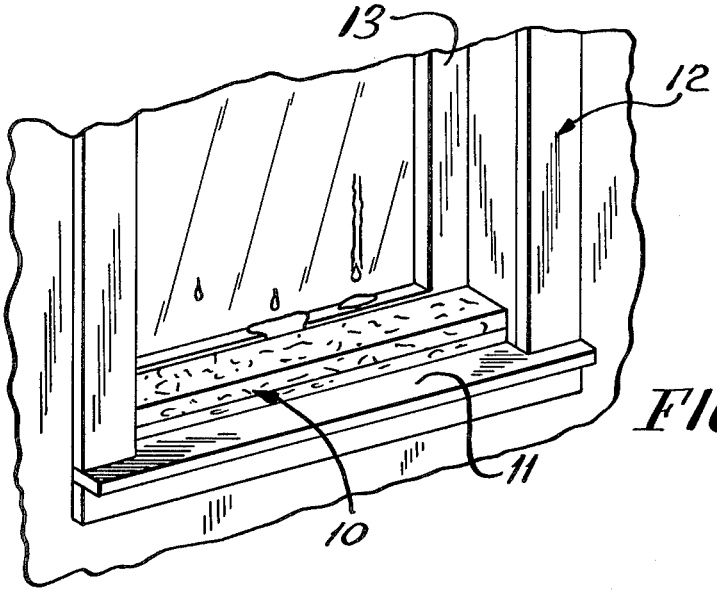
FIG. 1 is a fragmentary perspective view of a window structure having a moisture and air flow control device embodying the invention associated therewith.
Figure 2:
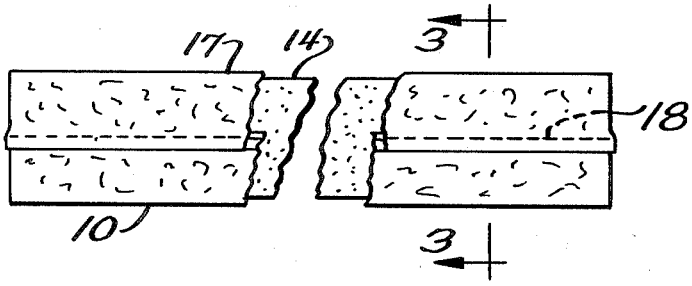
FIG. 2 is a front elevation of the control device.

In the illustrative embodiment of the invention as disclosed in the drawing, a window moisture and air flow control device generally designated 10 is placed on the windowsill 11 of a window structure generally designated 12 so as to collect condensate moisture which may form on the window and run down onto the sill.

Device 10 further serves as means for controlling air flow through the cracks between the lower edge of the window sash 13 and the sill 11.

Figure 3:
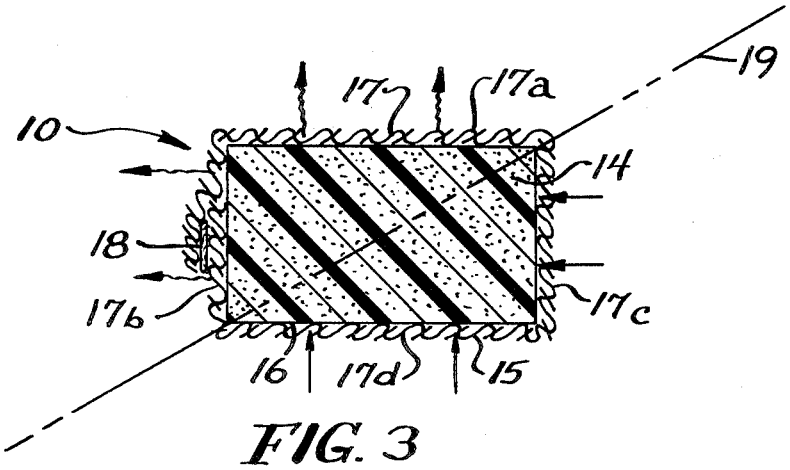
FIG. 3 is a transverse section taken substantially along the line 3—3 of FIG. 2.

As shown in the drawing, the control device includes a parallelepiped block 14 of liquid absorbing material, and a wicking means 15 enclosing the block. As shown in FIG. 3, the wicking means comprises a fabric which may be in intimate fluid transfer association with the entire outer surface 16 of the block. The outer surface 17 of the wicking means, in turn, is exposed outwardly over substantially its entire outer surface so as to provide an improved, large area fluid transfer mechanism for improved conduction of fluid to and from the absorbent block 14.

In the illustrated embodiment, the wicking material is flexible and, more specifically, may comprise a coarse cloth, such as terrycloth.

The wicking material may be removably installed about the block and secured in the installed arrangement by suitable securing means, such as Velcro® fastening means 18.

The absorbent block may be formed of an open cell synthetic resin, natural sponge material, etc., as desired.

The device, from time to time, may be cleaned as by removal of the wicking means and suitable laundering thereof. Similarly, the block 14 may be cleaned by suitable treatment with cleaning solution, such as detergent, or the like.

The wicking material may be provided in any suitable color, as desired, in coordination with the window treatment.

By providing sealing against drafts through the crack between the lower edge of the window sash and the sill, the device provides for improved efficiency and energy usage in the home or the like in which the device is used.

As the device is adapted to readily absorb liquids, it may further be used to provide a fire stop in the case of a fire by the soaking thereof in water and placing it in engagement with the window or across the space under a room door. Thus, the device further serves as a fire safety device.

By providing the wicking means in intimate facial engagement with the entire outer surface of the absorbent block, improved fluid transfer is provided effectively eliminating collected condensate on the windowsill and providing desirable evaporation of the water back into the room air as during low humidity condition periods during winter heating seasons and the like. Thus, the device still further serves as improved humidifying means.

As further illustrated in FIG. 3, control device 10 is substantially symmetrical about a longitudinally extending diagonal plane 19, thereby effectively defining oppositely paired, perpendicular surfaces, such as first pair of surfaces 17*a* and 17*b* and second pair of surfaces 17*c* and 17*d*. Thus, illustratively, moisture may be picked up by the device through surfaces 17*c* and 17*d* engaging the window sash and sill, respectively, with the device installed as illustrated in FIG. 1. At such time, moisture is evaporated from surfaces 17*a* and 17*b*, which are thusly exposed to the ambient atmosphere within the room. Thus, the portion of the wicking means defined by surfaces 17*a* and 17*b* may become somewhat drier than that defined by surfaces 17*c* and 17*d* in this arrangement. Resultingly, the user may rotate the device 90° so as to dispose surfaces 17*b* and 17*a*, respectively, in engagement with the window sash and sill for improved wicking of moisture therefrom into the absorbent block, with the surfaces 17*c* and 17*d* now being exposed to the room atmosphere for improved evaporation of the collected condensate therefrom. Thus, the entire peripheral outer surface of the device defines an effective wicking means for improved moisture control.

Thus, the moisture control device 10 is extremely simple and economical of construction while yet providing the highly desirable features discussed above.

The foregoing disclosure of specific embodiments is illustrative of the broad inventive concepts comprehended by the invention.

I claim:

1. In a window structure having a sash and a sill, said sash and sill having moisture liquid produced thereon as a result of climatic conditions, and said sash and sill cooperatively defining at times a crack therebetween, the improvement comprising:

a moisture and air flow control device comprising a block of liquid absorbing material; and wicking means enclosing said block defining outwardly exposed means for conducting moisture liquid from said sash and sill by wicking action to said block through a portion of the wicking means engaging the sash and sill, and from said block through a portion of the wicking means spaced from said sash and sill, effectively over the entire outer surface of the block, said wicking means being flexible and further defining means for blocking air flow through said crack as a result of the crack being covered by said device.

2. The window moisture and air flow control device of claim 1 wherein said wicking means comprises a rough textured fabric.

3. The window moisture and air flow control device of claim 1 further including means for removably securing the wicking means about said block.

4. The window moisture and air flow control device of claim 1 wherein said block is formed of an open cell material.

5. The window moisture and air flow control device of claim 1 wherein said block defines a parallelepiped outer surface.

6. The window moisture and air flow control device of claim 1 wherein said block defines a parallelepiped outer surface and said wicking means comprises a cloth enclosure fitted about said outer surface in intimate fluid transfer contact therewith.

7. The window moisture and air flow control device of claim 1 wherein said block is formed of a synthetic resin.

8. The window moisture and air flow control device of claim 1 wherein said device is substantially symmetrical about a longitudinally extending diagonal plane.

* * * * *